United States Patent [19]

Massey

[11] 4,017,927

[45] Apr. 19, 1977

[54] RING BUOY

[76] Inventor: David H. Massey, 139 Hawthorne, Glencoe, Ill. 60022

[22] Filed: Jan. 22, 1976

[21] Appl. No.: 651,421

[52] U.S. Cl. ..... 9/340; 9/311; 9/329; 264/DIG. 4; D34/43

[51] Int. Cl.[2] ..... B63C 9/10

[58] Field of Search ..... 9/14, 310 G, 310 B, 9/311, 329, 337, 340; D34/43; 272/1 B; 57/159; 156/158; 264/DIG. 4

[56] References Cited

UNITED STATES PATENTS

| | | | |
|---|---|---|---|
| 3,050,754 | 8/1962 | Le Blanc | 9/340 |
| 3,082,483 | 3/1963 | Bickford | 264/DIG. 4 |
| 3,145,400 | 8/1964 | Yoakum | 9/310 G |
| 3,200,437 | 8/1965 | Sasanko | 264/DIG. 4 |
| 3,244,346 | 4/1966 | Tijunelis | 264/DIG. 4 |
| 3,520,008 | 7/1970 | Frieder et al. | 9/340 |
| 3,594,836 | 7/1971 | Robertson | 9/340 |
| 3,616,475 | 11/1971 | Lewis | 9/340 |

FOREIGN PATENTS OR APPLICATIONS

| | | | |
|---|---|---|---|
| 97,442 | 1/1961 | Norway | 9/340 |

*Primary Examiner*—Trygve M. Blix
*Assistant Examiner*—Charles E. Frankfort
*Attorney, Agent, or Firm*—Robert L. Kahn

[57] ABSTRACT

This invention relates to a ring buoy (life preserver) consisting of a toroid or doughnut-shaped ring of a plastic foam, preferably but not necessarily of polystyrene foam, provided with an integral tough, wear-resistant and weather-resistant outer film of flexible strong material and having within the buoy near the outer circumference thereof within the material a continuous ring of strong, rigid material as iron, steel or other material having desirable weight characteristics. At spaced intervals indented in the outer edge of such ring are a plurality of regions, such as four, free of the buoy plastic material and providing access to such ring, whereby rope may be affixed to the ring buoy, this usually being required by rules and regulations governing the construction of such buoys and the use thereof on boats and marine facilities. By proper proportioning of the weight of the metal ring with respect to the weight of the plastic of the buoy, the entire construction may be endowed with highly desirable ballistic properties so that such a ring buoy may be handled and particularly thrown to spin or cause the buoy to spin during the flight thereof, such characteristics improving the ballistic properties of the entire buoy to permit the buoy to travel without being easily deflected by wind and imparting stability to the buoy while using light weight plastic for buoyancy. The entire buoy can have a smooth, unbroken surface, except for the recesses in the outer edge of the material. In addition, by utilizing synthetic rope material, recourse may be had to thermoplastic welding of the rope about exposed portions of the ring, thus facilitating the manufacture of the buoy without interfering with its safety and utility.

7 Claims, 4 Drawing Figures

RING BUOY

THE INVENTION GENERALLY

This invention relates to a ring buoy, commonly known as a life preserver, which has a foam plastic body of low density and thus high buoyancy, together with a reinforcing metal ring embedded in the toroidal shape of the ring body, such ring being disposed in the outer portion of the toroidal body with cutouts or free spaces in the outer portion of such ring body to expose lengths of ring at various regions along the ring body. Because of this construction, it becomes practical to firmly attach rope to the various available reinforcing ring portions to result in a complete ring buoy having a high degree of buoyancy, desirable ballistic characteristics for throwing, and susceptible to manufacture with minimum equipment and minimum manufacturing steps.

Prior Art Construction

Ring buoys made of plastic, having rope handles, are old. Such ring buoys, as a rule, utilize plastic, such as polystyrene PVC (polyvinyl chloride), polyurethane and the like, having a substantial degree of mechanical strength and requiring a plastic density of the general order of at least about six pounds per cubic foot of plastic. Such plastic buoys are molded to the desired toroidal shape, usually a flattened toroid, and come in various sizes as, for example, 20 inches in diameter, 24 inches in diameter and 30 inches in diameter. Suitable ropes are attached to such prior art ring bodies by anchoring the same with bands of fabric or sheet plastic encircling an arcuate portion of the ring completely around a toroid portion. Such bands are cemented or attached in suitable manner to anchor a rope at particular regions of the buoy, regulations as a rule requiring that there be rope loops extending along the complete outer edge of the toroid and anchored to the toroid outer portion at various places.

Advantages of the Invention

It is preferred, although not necessary, in the practice of the invention to use specially treated polystyrene foam, particularly of the low density variety (ranging from about ½ to about 1½ lbs. per cubic foot) as the buoy body material. This plastic foam is highly advantageous because of its extremely light weight and can be endowed with substantial resilience with regard to compression as hereinafter set forth. By using small polystyrene beads as the raw material for making the foam, it is possible to obtain a smooth, outer buoy surface.

It is preferred to provide a tough outer coating of PVC/ethylene copolymer or polyurethane or other suitable material by dipping in a liquid solution thereof the entire ring buoy. Application by spraying such solution is also possible. The thickness of the film coating can be of the general order of about 3 mils (0.003 inch) or more, such a coating being tough, resistant to abrasion and handling and protecting the surface of the polystyrene against mechanical abuse. Because of the light weight of the polystyrene foam, the combination of the light polystyrene foam ring buoy together with the metal ring insert substantially near the outer edge of said ring and symmetrically disposed between the axial thickness of the ring, the handling, feel and dynamic properties of the buoy are greatly enhanced.

Another important feature of the invention resides in the fact that rope made of thermoplastic material such as nylon, polypropylene, polyethylene and the like, may be used, such rope being threaded through the exposed metal ring portions at intervals and the thermoplastic rope material being adapted to be locally heated to melt the rope material and provide a permanent joint at the rope loop where it is threaded through the metal ring to completely retain the rope in desired position at the various exposed ring portions. The ends of the rope section used may also be welded together to form a continuum of rope about the ring.

While the shape of the buoy may vary, a simple ring or toroid is preferred, the top and bottom faces of the toroid or ring being preferably flattened.

The invention is not necessarily limited to utilizing polystyrene foam in the structure. It is possible to use other plastic foams, such as PVC (polyvinyl chloride), polyurethane or even rubber foams. However, low density polystyrene foam, suitably treated to have surface resiliency, is preferred, not only for its great buoyancy but also for its cost advantage and ready availability.

THE DRAWING

The invention will now be described in conjunction with the drawing, wherein.

DESCRIPTION OF THE NEW BUOY CONSTRUCTION

Figure 1:
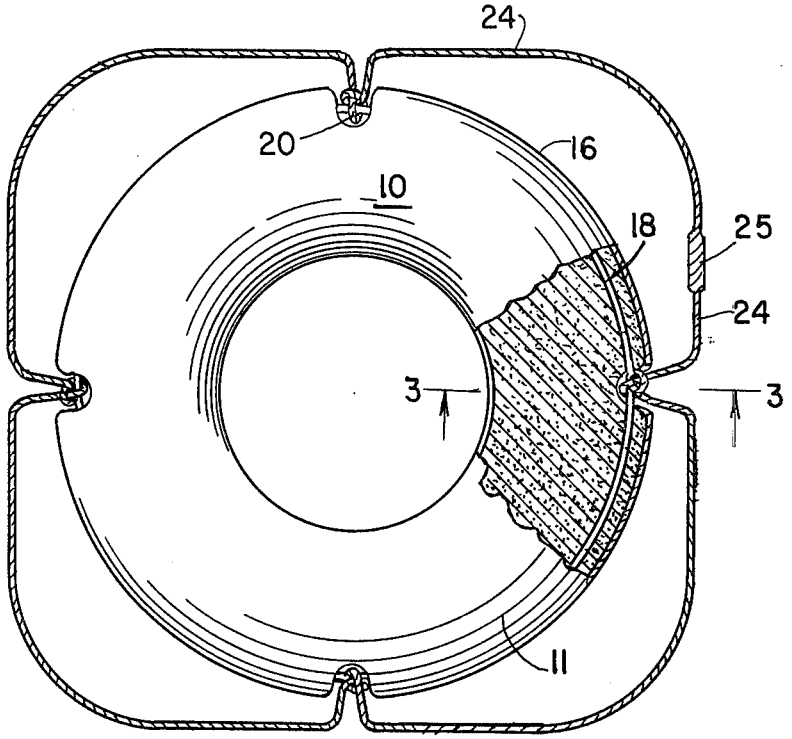
FIG. 1 is a plan view of an embodiment of the invention, part of the construction being broken away to show the interior thereof.
Figure 2:
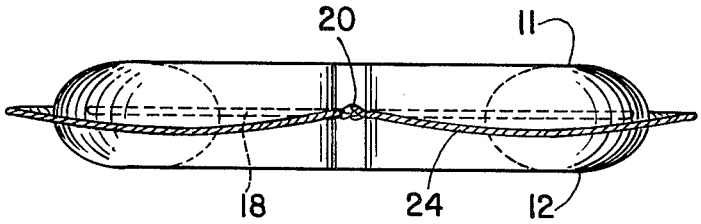
FIG. 2 is a side elevation of the buoy illustrated in FIG. 1.

A buoy embodying the present invention is molded of a foam of any of the plastics previously identified and in the case of the preferred species, is molded of polystyrene. The buoy is molded to a generally toroidal shape as illustrated, said toroidal shape preferably having flattened top and bottom faces 11 and 12. The diameter of inside face 15 may assume any desired value consistent with the regulations of, in the case of the United States, the Coast Guard, or any other agency. As an example, the inner toroid diameter of annular face 15 may range from about 8 inches up to any desired value. The outside face 16 may also have any desired diameter consistent with the inner diameter of the toroidal body. It is, of course, necessary to provide as much foam body 10 so that the volume of plastic foam will be sufficient to provide desired buoyancy. Molded interiorly of body 10 is metal ring 18 preferably of steel but of any other suitable material having the desirable characteristics of weight and strength and also being readily available at low cost. Ring 18 is preferably circular and the ring itself preferably has a circular cross section. It is possible to use metal rod or heavy gauge wire of non-circular cross section. However, circular cross-sectional shape of metal ring material is preferred as being readily available on the market and involving no problems with regard to availability, cost, ease of handling, and the like. Metal ring 18 is molded symmetrically within the foam body and close to the outer face 16 of the molded body. In practice, metal ring 18 may be disposed within about one-half of an inch from the outer face 16 of the toroidal body. However the spacing may vary widely. At spaced intervals, here shown as four equally spaced regions, are recesses 20 extending inwardly from the outermost part of outerface 16 of the toroidal body and inwardly sufficiently to expose small portions of ring 18 to view. Each recess 20 thus has a length of ring 18 extending across the recess and spaced radially from the recess bottom. Thus the exposed ring length is fully available for rope attachment after fabrication of the body.

Creating a toroidal foam of polystyrene involves blowing a quantity of pre-expanded beads into the interior of a mold thereafter heated so that an integral foam body is created. In this particular instance, the support of metal ring 18 within the mold chamber follows usual practice when providing metal inserts in plastic molding. In all instances, the center or axis of the steel wire will be well past the median diameter of toroidal body 10. In the practice of the invention, ring 18 will consist of steel wire having a thickness of about 5/16 inch which provides desired weight characteristics. This dimension of wire size may vary.

It is preferred to have the weight of metal ring 18 substantially greater than the weight of plastic. The ratio may vary within wide limits and will depend upon such factors as the density of plastic, and the amount of metal involved in the design of ring 18. Generally ring 18 should weigh in the range of 1 to 3 times the weight of plastic foam alone.

Figure 4:
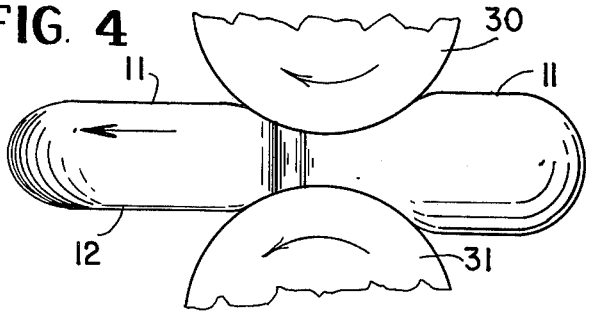
FIG. 4 is a diagrammatic showing a processing procedure of a preferred form of the invention wherein polystyrene is used for imparting resilience to said polystyrene.
Figure 3:
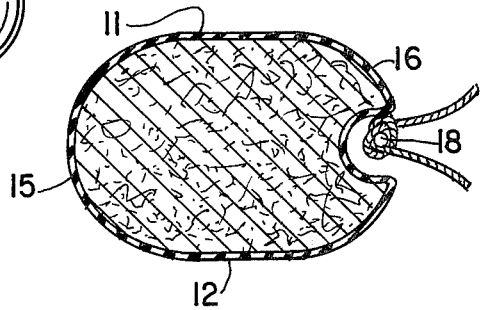
FIG. 3 is a sectional detail on lines 3—3 of FIG. 1.

It is desirable to have body 20 and ring 18 provided with suitable, overall tough adherent coating 24 which coating may be in one or more layers, due to successive sprayings or dippings in one material or different materials. In the event that foam body 10 of the buoy consists of low density polystyrene, it is necessary to first provide a tough primer coating of polyvinyl chloride-/ethylene copolymer, acrylic, or any other tough resistant material to protect the polystyrene foam against attack by solvents required to disperse stronger polymers present in outer coating materials such as polyurethane or PVC. The primer coating itself has a tough protective coating resistant to weather, salt water, etc., such as polyurethane or PVC. Where plastic foams other than polystyrene are used, the primer coating may usually be omitted and the entire foam body coating may consist of polyurethane or PVC or other material compatible with the foam body. It is understood that such weather resistant coating may actually be in one or more layers to provide desired thickness. It is well known that polystyrene foam does not have much resistance to mechanical abuse or abrasion and it would therefore be essential that an outer protective skin coating be applied to such a polystyrene body.

Where low density polystyrene foam is used for the body of the buoy and due to its normal lack of resilience, it is preferred to treat the foam body to a transient compression in a direction perpendicular to the flat faces of the toroid, that is, along the direction of the straight axis of the toroid. Such a procedure (preferably applied after ageing at least one day after molding) is diagrammatically illustrated in FIG. 4 of the drawing wherein body 10 of the buoy is run through a pair of rollers 30 and 31 turning in the direction indicated with body 10 moving in the direction indicated. The spacing between the opposed surfaces of rollers 30 and 31 (these rollers are cylindrical and extend perpendicular to the plane of the paper) is so selected that the original thickness of body 10 extending between opposed rollers 30 and 31 is momentarily reduced (in one or more steps) to about ½ and preferably to about 1/10 of the original foam thickness (limited naturally by wire thickness). It is possible to apply the compression over the range desired in successive steps rather than in one step. The buoy body is fed between the rollers at a speed of the order of about 20 feet per minute or greater, so that compression is momentary.

It has been found that such transient compression applied to low density polystyrene foam results in imparting resilience to the foam in the direction in which the original compression had been applied.

A tough, adherent, protective coating or skin must be provided over the foam body, irrespective what foam is used. The tough reinforcing skin created or applied to the outer surface of toroid body 10 will range in total thickness from the order of about 5 mils (0.005 inch) or more, depending upon the degree of wear and tear to be expected. An initial or primer coating for polystyrene foam is preferably applied by dipping, then drying and dipping again. The dipping bath for the preferred form of the invention (low density polystyrene foam) should be adherent to the foam and not have any undesired action thereon. As an example a bath of water dispersion of PVC ethylene copolymer, approximately 60% solids may be used for 2 or 3 successive dips, the entire buoy molding being dried after each dip. Exposed ring portions are thus coated to protect against rusting while all plastic surfaces of foam are coated. Thereafter, one or two dips in a polyurethane bath may be provided, if added protection is deemed desirable.

By having the transient compression procedure ahead of coating, wrinkling of the coating is prevented.

The buoy is completed by the application of rope 24 threaded around to the exposed portions of metal ring 18. Rope 24 is preferably of thermoplastic material, such as polypropylene, polyethylene, or nylon, and is preferably looped through and knotted at the successive exposed portions of metal ring 18. The loops at the ring portions may be heated by suitable means so that the rope material is welded or fused together to form a permanent knot attaching same to the ring portions. The ends of rope 24 may also be permanently welded or fused together by heat at 25 so that an endless rope is provided. Such rope loops are generally mandatory in connection with life ring buoys for various marine use. It is understood that the diameter of rope 24 is sufficient so that the rope has substantial tensile strength.

The rope is permanently anchored to the buoy and the entire buoy construction is well protected against corrosion in water, fresh or salt, and will have a long useful life. In the case of a low density polystyrene foam buoy, the presence of metal ring 18 permits the buoy to be thrown to cause the toroid to spin about its axis and travel in a desired direction with minimum deflection by wind. The buoy construction, particularly when made of low density polystyrene, has a desirably low weight and with its excellent buoyancy characteristics, provides a desirable addition to marine safety. While the invention is not limited to the use of low density polystyrene, the presence of such low density polystyrene is highly advantageous.

In connection with the manufacture of polystyrene foam buoys (as with other low density polystyrene foam products) where a transient compression step is to be provided, the curing or ageing of a foam molding should permit drying as when steam has been used in the expansion of the plastic beads, and also to be at least at normal room temperature and normal room humidity. As a rule, no special precautions need be taken after molding and prior to compression unless the molding has been stored or kept in a frigid environment for a time prior to compression. Otherwise a molding stored for several days under normal room conditions can be compressed as heretofore set forth.

Geometrically a toroid is a solid whose outer surface is generated by a circle, as a generatrix, being revolved perpendicular to its plane about a straight line, which can be designated as a toroid axis. In the buoy embodying the invention, the generating circle may be flattened somewhat to provide toroid top and bottom faces 11 and 12. This flattening is unimportant and may be omitted. The rounded inner and outer toroid faces need not be truly circular. Sharp edges are to be avoided. In referring to the toroid inner and outer faces, surfaces 15 and 16 are identified as such.

What is claimed is:

1. A ring buoy having a generally toroidalshaped body substantially of plastic foam material having great buoyancy, said body when horizontally viewed showing in plan two concentric circles defining respectively the inner and outer body sides and the circle center defining the straight axis of the toroid body, the annular region between the concentric circles comprising the top face of the body, a transverse section of the ring body in a plane containing the straight toroid axis having a rounded shape, said body also having a bottom face, said body having a tough adherent plastic coating thereover, a metal ring in the body symmetrically between the top and bottom body faces and symmetrically within the outer body side and substantially closer to the outer body side than to the inner body side, said body having a plurality of shallow recesses inwardly from the outer body side at spaced angular intervals, each recess being so shaped and dimensioned as to expose a small length of ring, said ring length having sufficient free space around it to accommodate rope attachment thereto after buoy fabrication whereby the ballistic properties of the buoy are maximized and the shallowness of the recesses minimizes structural weakening.

2. The construction according to claim 1, wherein said body is substantially of molded low density polystyrene.

3. The construction according to claim 2, wherein said foam has a density of the order of from about 0.5 to about 1.5 lbs. per cubic foot.

4. The construction according to claim 2, wherein said polystyrene foam has at least a substantial portion thereof treated by transient compression to develop resilience therein for a substantial depth from the top and bottom faces of said body.

5. The construction according to claim 1, wherein said body has been subjected to transient compression sufficient to reduce the thickness of the material down to the order of at least about ½ of the original foam thickness, said foam after release from said compression recovering a substantial portion of its thickness with resilience and thereafter permitting limited compression and recovery in a direction between the top and bottom faces of the toroid.

6. The ring buoy construction according to claim 1, wherein a rope of synthetic thermoplastic fiber is threaded through the exposed ring portions, said rope being locked in place at ring portions by melting said rope material to weld the rope portions together to provide a permanent joint.

7. The construction according to claim 6, wherein the rope ends are welded together.

* * * * *